United States Patent [19]

Tsushima et al.

[11] 4,142,828

[45] Mar. 6, 1979

[54] OPENABLE ROTOR CHAMBER CONSTRUCTION FOR A VERTICAL BLOWER

[75] Inventors: Ken Tsushima, Nagasaki; Hisashi Takahashi, Nakayo, both of Japan

[73] Assignee: Mitsubishi Jukogyo Kabushiki Kaisha, Tokyo, Japan

[21] Appl. No.: 784,627

[22] Filed: Apr. 4, 1977

[30] Foreign Application Priority Data

Jun. 4, 1976 [JP] Japan ..... 51-71508[U]

[51] Int. Cl.[2] ..... F23J 11/00

[52] U.S. Cl. ..... 415/201; 29/401 R; 29/156.8 R; 110/162; 110/184

[58] Field of Search ..... 98/58, 59, 60; 110/162, 110/184; 415/201, 219 R, 118; 29/463, 401 R, 401 F, 156.8 R

[56] References Cited

U.S. PATENT DOCUMENTS

| | | | |
|---|---|---|---|
| 780,497 | 1/1905 | Fullagar | 415/201 |
| 1,243,135 | 10/1917 | Bobo | 415/201 |
| 1,454,561 | 5/1923 | Pray | 110/162 |
| 2,761,742 | 9/1956 | Hintz et al. | 110/184 X |

FOREIGN PATENT DOCUMENTS

| | | | |
|---|---|---|---|
| 1008217 | 5/1957 | Fed. Rep. of Germany | 415/201 |
| 4263 | 8/1919 | Netherlands | 415/201 |
| 56536 | 2/1911 | Switzerland | 98/59 |
| 664011 | 1/1952 | United Kingdom | 415/201 |

*Primary Examiner*—William F. O'Dea
*Assistant Examiner*—Harold Joyce
*Attorney, Agent, or Firm*—Wenderoth, Lind & Ponack

[57] ABSTRACT

An openable rotor chamber structure for a vertical blower which is disposed on a floor provided within the base section of a smokestack or the like to exhaust smoke within a flue and discharge the same up the stack. The rotor chamber structure has a rotor chamber divided into two equal longitudinally extending portions which can be coupled or separated at a transverse dividing plane including the axis of the chamber, the respective parts of the blower being mounted on one of the two casing portions. A support frame is rotatably anchored on the floor by pins and the casing portion on which the parts of the blower are mounted is fixedly secured thereto. A mechanism is provided for moving the other of the two casing portions on which the members of the blower are not mounted in a horizontal direction.

5 Claims, 5 Drawing Figures

OPENABLE ROTOR CHAMBER CONSTRUCTION FOR A VERTICAL BLOWER

The present invention relates to an openable rotor chamber structure for facilitating maintenance, inspection and repair of a vertical blower disposed in a base section of a smokestack or the like as an induced draft fan.

BACKGROUND OF THE INVENTION AND PRIOR ART

When a vertical blower is used as an induced draft fan, normally it is installed in a base section of a smokestack. This is done because this blocks the noise caused by the blower, and shelters the blower from wind and rain, thus avoiding the necessity for a separate shed for accommodating the blower, and the like.

FIGS. 1–3 show a common arrangement of this type of vertical blower, in which reference numeral 1 designates a smokestack installed on a foundation E, and at the base section of the smokestack 1 are provided a lowermost floor 1*a* consisting of the foundation E and upper floors 1*b*, 1*c* and 1*d* projecting inwardly from the inner circumferential wall of the smokestack 1 at appropriate intervals above said floor 1*a* in a multi-layer form. Among these floors, on the floor 1*b*, or the so-called second floor, are installed, in the illustrated embodiment, two motors 2. In addition, an opening $h_2$ is provided in said floor 1*b* through which a blower 3 to be described later can be passed. Two blowers 3 are detachably mounted on the third floor 1*c* so that they can be driven respectively by said two motors 2, and they are adapted to suck exhaust gas through flues D connected to an exhaust smoke source (not shown) and to blow the gas through ducts d connected to the blowers via expansion joints 4. It is to be noted that the top level floor 1*d* has the role of supporting the ducts d and is also useful for performing maintenance operations for associated instruments within said ducts d.

When maintenance, inspection and repair operations for the vertical blower 3 that is disposed at the base section of the smokestack in the above-described manner are required, as shown in FIGS. 2 and 3 the blower 3 is disconnected from the expansion joint 4 and is moved laterally, sliding along rails 5 that are preliminarily laid on the floor 1*c* as best seen in FIG. 2, subsequently lifted by a weight-lifting apparatus such as a hoist that is fixedly mounted on the lower surface of the floor 1*d*, and then it is lowered down to the lowermost floor 1*a* through the openings $h_2$ and $h_3$ provided in the floor 1*c* and in the floor 1*b*, respectively. When the blower is on said floor 1*a*, the rotor chamber is opened to perform the maintenance, inspection and repair operations.

The disadvantages of this arrangement are that a rather large space is required on the floor 1*a*, resulting in an increase in the construction cost of the smokestack, and, in order to lower the blower 3 onto the floor 1*a*, a lot of labor is required and the lowering operation involves some danger.

OBJECT AND BRIEF SUMMARY OF THE INVENTION

The present invention has as an object eliminating the aforementioned disadvantages of the prior art arrangement. To this end it is constituted by an openable rotor chamber structure for a vertical blower which is disposed on a floor provided within the base section of a smokestack or the like for sucking exhaust gas within a flue and discharge the same up the stack. The rotor chamber structure has a rotor chamber divided into two equal longitudinally extending portions which can be coupled or separated at a transverse dividing plane. The parts of said blower are mounted on one of the two casing portions, a support frame is rotatably anchored on said floor by pins and has the casing portion on which said members of the blower are mounted fixedly secured thereto, and means are provided for moving the other of said two casing portions, i.e. the portion of which the members of the blower are not mounted, in a horizontal direction.

BRIEF DESCRIPTION OF THE DRAWINGS

The invention will now be described in the following specification, taken together with the accompanying drawings, in which.

DETAILED DESCRIPTION OF THE INVENTION

Figure 1:
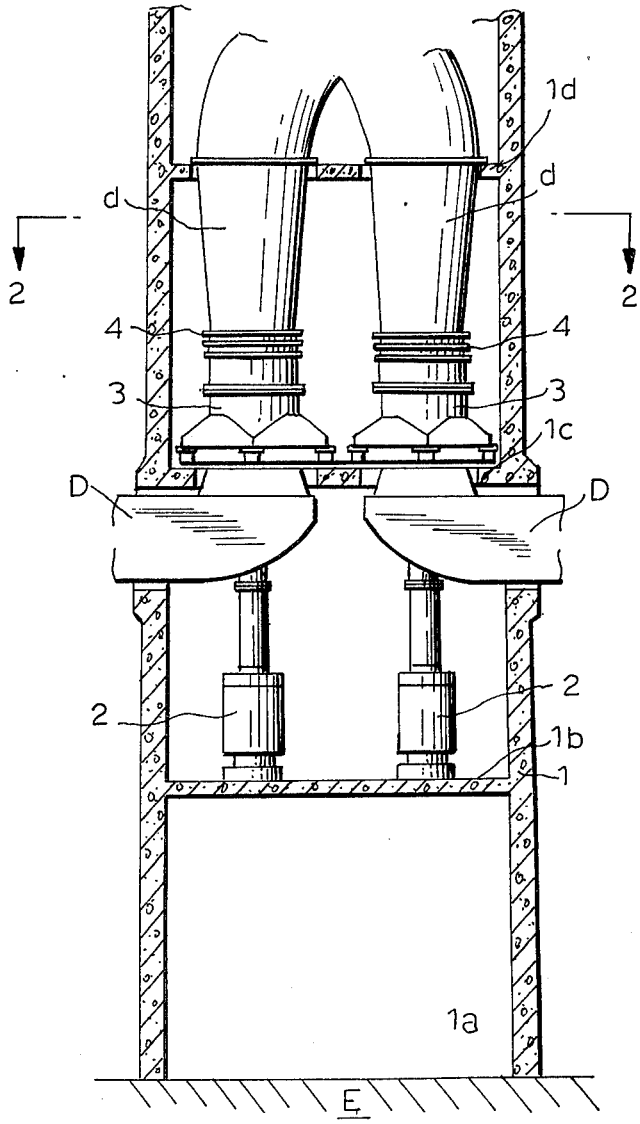
(PRIOR ART) FIG.1
FIG. 1 is a sectional elevation view of the installation of vertical blowers within a smokestack according to the prior art.
Figure 2:
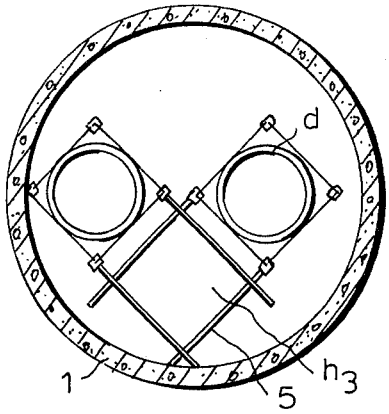
(PRIOR ART) FIG.2
FIG. 2 is a transverse cross-section taken along line 2—2 in FIG. 1.
Figure 3:
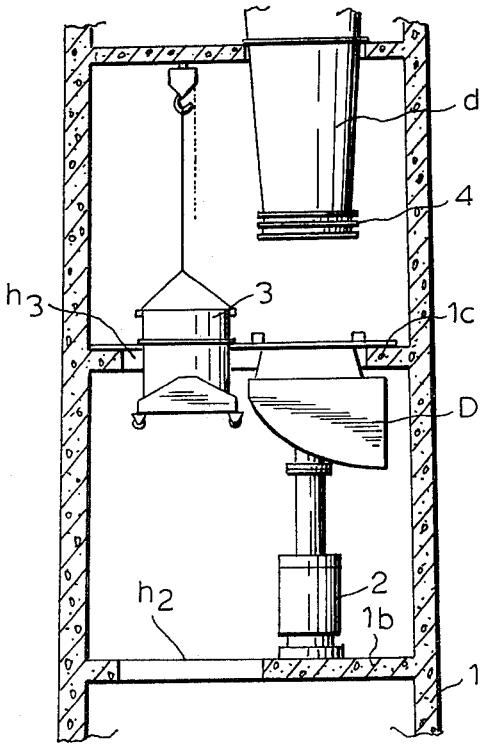
(PRIOR ART) FIG.3
FIG. 3 is a partial sectional elevation view showing the operations necessary for repair, inspection, etc. of the blower.
Figure 4:
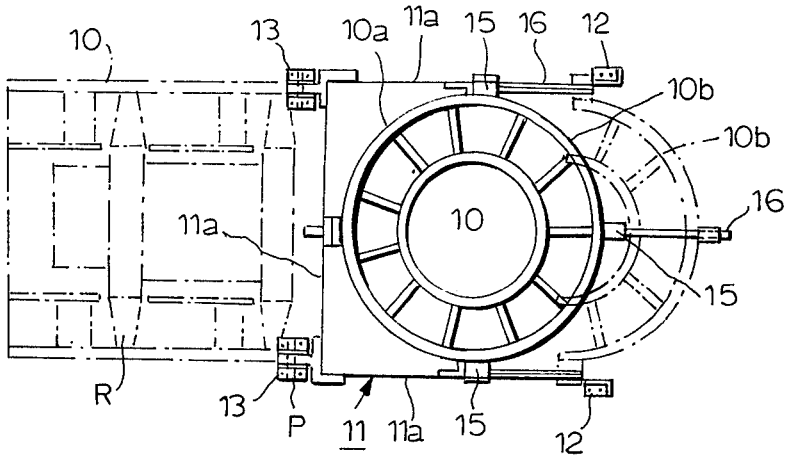
FIG. 4 is a plan view of one preferred embodiment of the openable rotor chamber structure according to the present invention.
Figure 5:
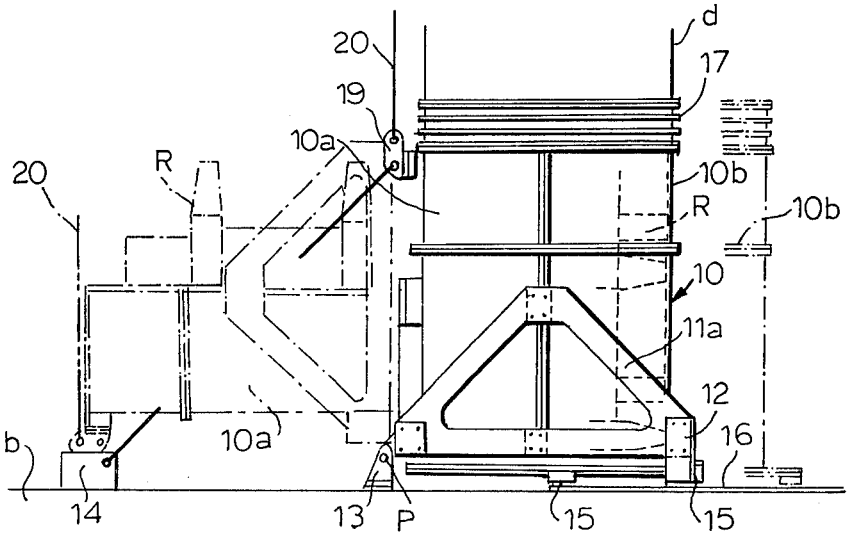
FIG. 5 is a side elevation view thereof.

Referring to FIGS. 4 and 5, reference numeral 10 designates a generally cylindrical rotor chamber of a vertical blower, and this rotor chamber 10 is constructed by detachably joining a longitudinally extending casing portion 10*a* and a longitudinally extending casing portion 10*b*, at a transverse plane including the longitudinal axis of the chamber and dividing the chamber into two halves. The casing portions 10*a* and 10*b* are secured to each other by bolts or the like (not shown). One casing portion 1*a* (the left hand one in FIGS. 4 and 5) has a blower rotor R and bearings for supporting the same mounted therein, but the other casing portion 10*b* merely serves as a cover and is not connected to the rotor and the bearings at all. Reference numeral 11 designates a support frame for supporting the rotor chamber containing the respective members of the blower therein, the support frame 11 being constructed by integrally connecting triangular shape members 11*a* as shown in FIG. 5 into a cradle for casing portion 10*a* as shown in FIG. 4, and the support frame 11 is disposed so as to surround three sides of the rotor chamber 10 other than the outside of the casing portion 1*b*. Top center portions and bottom center portions of the respective triangular members 11*a* in the support frame 11 are coupled to the casing 10*a*. The ends of the bottom portions of these triangular members 11*a* toward the casing portion 10*b* are detachably connected to brackets 12 provided on a second floor corresponding to the second floor 1*b* in FIG. 1 on opposite sides of the support frame 11, and in addition, the other ends of the bottom portions, i.e. those toward the casing portion 10*a* are pivotably mounted on a pair of brackets 13 projecting from the floor on the opposite sides of the support frame 11 by pins P.

Accordingly, when the securing means securing the casing portions 10*a* and 10*b* forming the rotor chamber 10 are removed and the connection between the ends of the triangular members 11*a* of the support frame and the brackets 12 is released, then the casing portion 10*a* containing the respective members of the blower can be rotated about the pins P and thus can be displaced from the position shown in solid lines to the position shown by the double-dot chain lines in FIGS. 4 and 5 or vice versa.

It is desirable to provide a support member 14 on the floor 1*b* for supporting one end of the casing portion 10*a* of the rotor chamber 10 when said casing portion 10*a* is in the position shown by the double-dot chain lines.

Reference numeral 15 designates rollers mounted on the lower end of the casing portion 10*b* adjacent the joint between the casing portions 10*a* and 10*b* and at the middle of the periphery of casing portion 10*b*. Rails 16 are laid on the floor 1*b* as shown in FIG. 4, said rollers 15 being adapted to run along these rails 16 for displacing the casing portion 10*b* from the position shown in solid lines to the position shown by the double-dot chain lines in FIGS., 4 and 5 or vice versa to separate casing portion 10*b* from portion 10*a*. The rollers 15 and rails 16 form means for moving the casing portion 10*b* in a horizontal direction. Reference character d designates a duct connected to the rotor chamber 10 by an expansion joint 17, and said duct d is adapted to be supported from a floor (not shown) just above the floor 1*b* similarly to the known vertical blowers. Though omitted from illustration, a drive motor for driving the rotor R within the rotor chamber 10 is disposed on the floor at the lowermost level of the smokestack corresponding to the floor 1*a* in FIG. 1.

In FIG. 5, reference numeral 19 designates a bracket projecting from the outer side of the upper portion of the casing portion 10*a* numeral 20 designates the rope of a hoist (not shown), and numeral 21 designates a rope stretched between said bracket 19 and said support member 14. While this rope is useful for positioning the casing portion 10*a* correctly in a vertical position when the casing 10*a* has been rotated about the pin P from the position shown by the double-dot chain lines to the solid line position, it is not always necessary to provide the rope 21.

One preferred embodiment of the structure according to the present invention is constructed as described above, and in operation the rotor R in the rotor chamber 10 is driven by the drive motor to such exhaust gas from a flue (not shown) and discharge the same to the smokestack through the duct d, similar to the conventional devices. However, for performing maintenance, inspection and repair operations on the rotor R in the rotor chamber 10, after the securing means between the respective casing portions 10*a* and 10*b* of the rotor chamber 10 has been released, if the casing portion 10*b* is displaced rightwardly by rolling on the rollers 15 and the rails 16 from the solid line position to the double-dot chain line position in FIGS. 4 and 5, then an operator can easily approach the rotor R and the like in the rotor chamber 10 to carry out the operations. Although most of the operations such as maintenance and inspection operations can be achieved with the parts in the above-described positions, in case the operation is a large scale operation or it is necessary to take the rotor R out of the chamber 10, than after the connection between the bracket 12 and the support frame 11 has been released, if the rope 20 of the movable hoist is engaged with the bracket 19 and the rope 20 is paid out while moving said hoist leftwardly in FIG. 5, then the casing portion 10*a* containing the rotor R and the like therein will rotate about the pins P and will swing down from the solid line position to the double-dot chain line position due to its own weight, and thus the casing portion 10*a* is opened out, so that removal of the rotor R and other maintenance, inspection and repair operations can be carried out easily. It is to be noted that on the floor at the lowermost level in the base portion of the smokestack, only a space large enough to install a drive motor is required. Further, it is to be noted that in order to join the respective casing portions 10*a* and 10*b* of the rotor chamber 10, it is only necessary to carry out the above-described steps of operation in the opposite sequence.

Since the structure according to the present invention has the aforementioned construction and operation, according to the present invention the following practical advantages can be attained:

(1) Opening and closing operations of the rotor chamber 10 can be achieved simply, speedily and safely in comparison to the heretofore known devices.

(2) All the necessary operations can be carried out on the same floor where the blower is installed without the necessity of providing a specially large operation space in the base portion of the smokestack, as is the case with the heretofore known devices, so that the cost of installation becomes cheaper.

What is claimed is:

1. An openable rotor chamber structure for a vertical blower disposed on a floor provided within the base section of a smokestack for exhausting gas within a flue and discharging it to the stack, said blower having the rotor shaft positioned vertically, said structure comprising a generally cylindrical rotor chamber having a vertical longitudinal axis and two equal vertically extending longitudinal casing portions detachably joined along a vertical transverse dividing plane including the vertical longitudinal axis of the chamber, one of the casing portions having the parts of the blower mounted therein, pivotal mounting means on the bottom of said one casing portion pivotally mounting said one casing portion on the floor within the base section of the smokestack for pivotal movement around a horizontal axis in said pivotal mounting means in a direction away from the other casing portion, and the other of said casing portions having no blower parts mounted therein being mounted for horizontal movement away from said one casing portion in a direction transverse to said dividing plane while remaining in the vertical position.

2. An openable rotor chamber structure as claimed in claim 1 further comprising a support member on the floor for supporting the end of the one casing portion when it has been pivoted to the fully pivoted position.

3. An openable rotor chamber structure as claimed in claim 1 further comprising hoist means coupled to said one casing portion for pivoting said casing portion in both directions around said pivotal mounting means.

4. An openable rotor chamber structure as claimed in claim 1 in which said other casing portion has rollers on the lower end thereof and rails are provided on said floor along which said rollers roll for moving said other casing portion.

5. An openable rotor chamber structure as claimed in claim 1 in which said pivotal mounting means is at the edge of said one casing portion which is remote from the other casing portion.

* * * * *